US005328095A

United States Patent [19]

Wickenhaver

[11] Patent Number: 5,328,095

[45] Date of Patent: Jul. 12, 1994

[54] SELF-CONTAINED SPRAY GUN APPARATUS WITH SPHERICAL PAINT CUP

[75] Inventor: Thomas A. Wickenhaver, West Babylon, N.Y.

[73] Assignee: Grumman Aerospace Corporation, Bethpage, N.Y.

[21] Appl. No.: 44,207

[22] Filed: Apr. 8, 1993

[51] Int. Cl.[5] ..... B05B 9/04; B05B 7/24; B05B 15/02

[52] U.S. Cl. ..... 239/113; 239/346; 239/367; 239/373; 901/43

[58] Field of Search ..... 239/112, 113, 346, 364, 239/365, 367, 373, 334; 222/211, 463, 464; 901/43

[56] References Cited

U.S. PATENT DOCUMENTS

| | | | |
|---|---|---|---|
| 361,010 | 4/1887 | Houchin et al. | 239/365 X |
| 692,485 | 2/1902 | Seltzer | 239/373 X |
| 2,029,141 | 1/1936 | Warner | 239/365 X |
| 2,372,678 | 4/1945 | McKay | 239/367 X |
| 3,490,656 | 1/1970 | Taschner | 222/464 X |
| 3,731,145 | 5/1973 | Senay . | |
| 4,285,446 | 8/1981 | Rapp et al. | 239/112 X |
| 4,460,126 | 7/1984 | Gates et al. | 239/112 |
| 4,630,567 | 12/1986 | Bambousek et al. . | |
| 4,694,975 | 9/1987 | Hagan | 222/464 X |
| 5,060,860 | 11/1991 | Megerle . | |
| 5,119,992 | 6/1992 | Grime | 239/364 |
| 5,195,664 | 3/1993 | Rhea | 222/464 |

FOREIGN PATENT DOCUMENTS

| | | | |
|---|---|---|---|
| 285040 | 10/1988 | European Pat. Off. | 239/334 |
| 177004 | 7/1935 | Switzerland | 239/365 |

*Primary Examiner*—Andres Kashnikow
*Assistant Examiner*—William Grant
*Attorney, Agent, or Firm*—Bacon & Thomas

[57] ABSTRACT

A self-contained spray painting system includes a spray gun for spraying paint under pressure, and a spherically shaped paint container attached to the spray gun for holding a quantity of paint to be sprayed. A flexible pick-up extends into the container and includes a weighted head that moves along an inner surface of the container and remains at the lowest point thereof as the container is moved through different orientations, whereby the pick-up remains immersed in paint in the container. The weighted head also functions to mix the paint as the container is moved through different orientations during use. An external purge system is connected with the paint inlet of the gun and is selectively operable to supply air under pressure through the paint inlet and nozzle to clean paint residue and other foreign matter from the gun at the conclusion of a painting operation.

15 Claims, 5 Drawing Sheets

SELF-CONTAINED SPRAY GUN APPARATUS WITH SPHERICAL PAINT CUP

TECHNICAL FIELD OF THE INVENTION

This invention relates generally to spray guns. More particularly, the invention relates to paint spray guns, and especially to paint spray guns of the type used in robotic equipment for spray painting.

BACKGROUND ART

Robotic spray painting facilities are widely used in repetitive tasks and in situations where a health hazard may be involved, or where there is a special need to insure consistent results in coating quality and film thickness, for example.

Even the most skilled painters may find it difficult to apply paint with the same film thickness and quality over repeated jobs when using hand-held spray painting equipment. Moreover, where painting is repetitive, workers may find the job to be monotonous and tedious, leading to inattentiveness and reduced production and quality. Other situations may require the use of hazardous or toxic materials which are a threat to the health of workers, who may therefore be unable or unwilling to work. Many jobs also involve areas to be painted that are hard to reach, making it difficult for workers to apply a proper coating and potentially leading to reduced production and quality. For example, the lengthy air intake ducts of aircraft engines are laborious to paint with hand-held spray guns. It is difficult for workers to get into and out of these ducts, especially when fresh coats of paint have already been applied, and care must be taken to avoid nicking or scuffing of the paint that has already been applied.

Although robotic paint spraying equipment may solve these problems, some prior art spray gun apparatus require the use of a paint holding tank located remotely from the spray gun, with lengthy hoses leading from the holding tank to the spray gun. A pressure pump is also required to move the paint from the holding tank to the spray gun, and a mixing device must be used to keep the paint properly mixed during a spraying operation. Moreover, an accumulator is required in order to eliminate fluctuations in the flow of paint, and in closed loop, paint circulating systems a return line leads from the spray gun back to the pump.

Paint cure time is important, and many paints used today are two-part mixes. When the two parts are mixed together they start to cure, and the time in which a paint can be used after it is mixed is generally short. Thus, it is desirable to mix only limited quantities of paint at a time. However, because of the amount of equipment and length of hoses required in the prior art systems discussed above, several gallons of paint must be mixed in order to charge or prime the system and to provide enough paint for the job. As the paint passes through the various pieces of equipment and lengths of hoses it begins to cure and thicken. In order to maintain proper pressure at the head of the spray gun, the pump pressure must be increased. If the paint becomes too thick to flow properly, it may have to be discarded.

Further, when prior art systems are discharged, the paint that fills the various pieces of equipment and lengths of hoses is disposed of and wasted. Those items which must be emptied and cleaned include the holding tank, the accumulator, the pump, the mixing system, the hoses, and the gun itself. Cleaning fluids used to flush and clean the system are also discarded after use. If colors are changed often, or if the paint becomes too thick to use, a considerable amount of paint and cleaner are therefore wasted.

Since the paints in common use today may cost $150 or more per gallon, and two to five gallons may be wasted each time the system is discharged, the cost of materials alone required to prime and discharge a prior art system can be considerable. Moreover, the time required for priming and cleaning, and the inconvenience to the operator in use of prior art systems, contribute to increased cost.

Accordingly, there is need for a spray painting system which requires only an amount of paint to be mixed that is needed to paint an object, and which does not require an excess amount of paint just to charge the system, thereby eliminating the waste of paint and cleaning materials that occurs in prior art systems.

It would further be desirable to have a spray painting system which does not require a separate pressure pump, or system accumulator, or tank mixing system, or paint holding tank, or paint return line, thereby reducing equipment and maintenance costs. Still further, it would be desirable to provide a system that does not require complete system discharge and cleanup each time the paint is used up and/or discarded.

DISCLOSURE OF THE INVENTION

Accordingly, it is an object of the present invention to provide a spray painting system which requires only an amount of paint to be mixed that is needed to paint an object, and which does not require an excess amount of paint just to charge the system, thereby eliminating the waste of paint and cleaning materials that occurs in prior art systems.

The spray painting system of the invention eliminates the need for extra equipment, such as a separate pressure pump, or system accumulator, or tank mixing system, or paint holding tank, or paint return line, thereby reducing equipment and maintenance costs.

Further, the system of the invention does not require complete system discharge and cleanup each time the paint is used up and/or discarded.

These advantages are achieved in the system of the invention by providing a robotic spray painting system which is self-contained, with a receptacle for the paint disposed in close association with the spray gun, thereby eliminating lengthy paint supply and/or return lines and associated equipment. Further, the receptacle or paint cup of the invention may be oriented and operated in any position through 360° of movement.

The paint spray gun of the invention has an external purge system which uses a source of air under pressure that is separate from the air flowing through the gun to atomize the paint, and is selectively operable for cleaning the gun at the conclusion of a painting operation.

The foregoing objects and advantages of the invention are achieved by modifying a conventional paint spray gun, and especially one adapted for use in a robotic spray painting system, although the principles are also applicable to a hand-held paint spray gun.

In accordance with the invention, a spherical paint cup is attached directly to the spray gun, with a flexible paint pick-up that automatically follows the lowest point in the cup as its orientation is changed, thereby insuring that paint will be supplied to the gun regardless of its orientation.

The paint pick-up also functions as a means to continually mix the paint in the cup as the gun and paint cup are moved about during a painting operation.

Air pressure is supplied to the cup to pressurize the paint and force it through the gun, and an air space is provided in the cup to define an accumulator to smooth out fluctuations in air pressure and paint flow.

In a particular embodiment of the invention, a conventional robotic paint spray gun is modified by removing the paint supply and return lines that normally connect the gun with a remotely located paint holding tank, and by connecting a regulated air pressure line with a spherical paint cup attached to the gun to pressurize the paint in the cup and cause it to flow to the gun through a flexible paint pick-up. The pick-up is connected with the gun at the point where the paint return line is normally connected in a conventional system. A purge line is connected with the gun at the point where the paint inlet fitting is normally connected in a conventional system.

BRIEF DESCRIPTION OF THE DRAWINGS

These and other objects and advantages of the invention will become apparent from the following detailed description when considered in conjunction with the accompanying drawings, wherein like reference characters designate like parts throughout the several views, and wherein.

BEST MODE OF CARRYING OUT THE INVENTION

Figure 1:
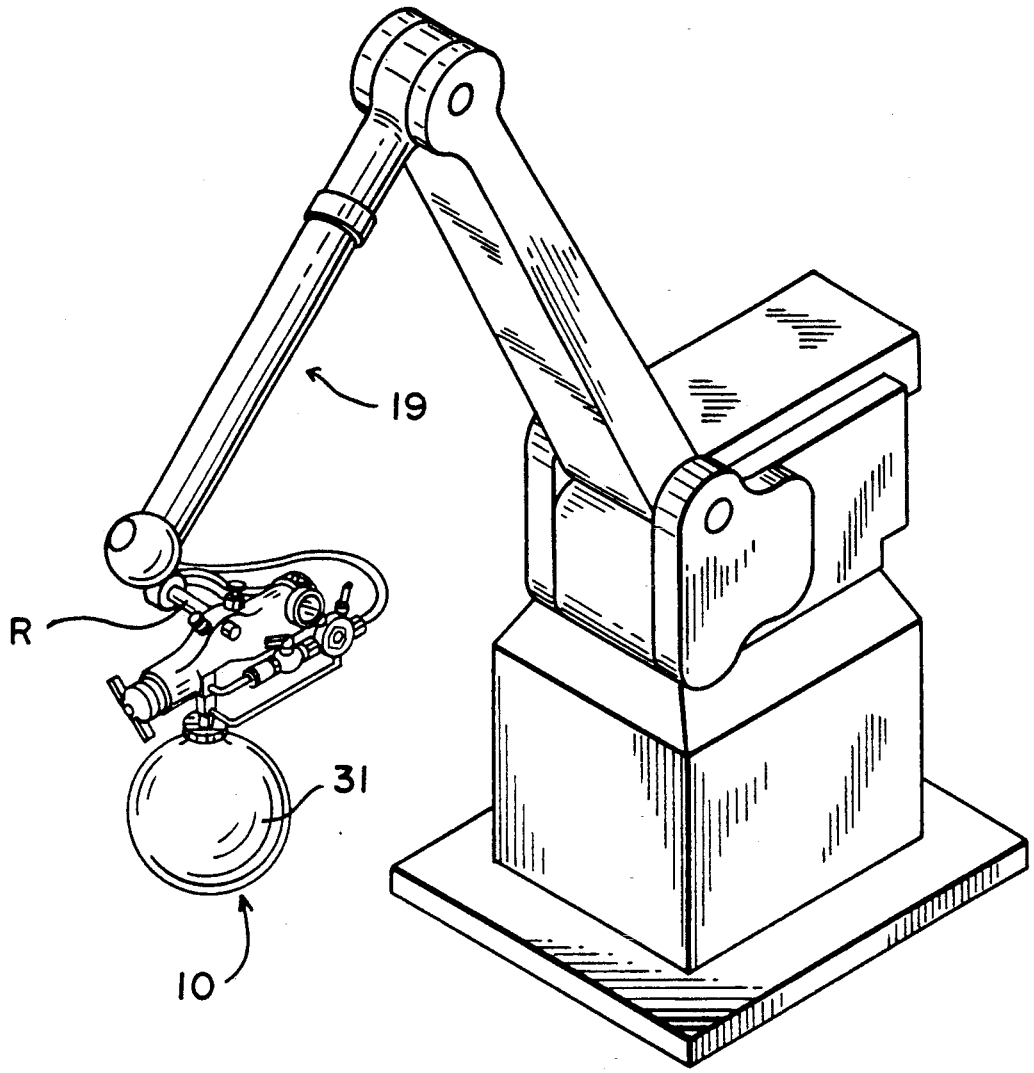
FIG.1 is a somewhat schematic perspective view of a robotic paint spraying system incorporating the features of the invention.

Referring more specifically to the drawings, a paint spray gun according to the invention is represented generally at 10 in FIGS. 1 and 3–6, and comprises a gun body 11 having a nozzle 12, needle valve 13, and the usual air mixing valve 14 and spray pattern adjustments 15. Connections 16 and 17 are also provided for supplying atomizing air and air for turning the gun on and off, respectively, as in a conventional remotely controlled robotic gun. In the particular model shown, a robot arm attachment point 18 is also provided for attaching the gun to a robotic control system 19 as shown in FIG. 1.

Figure 2:
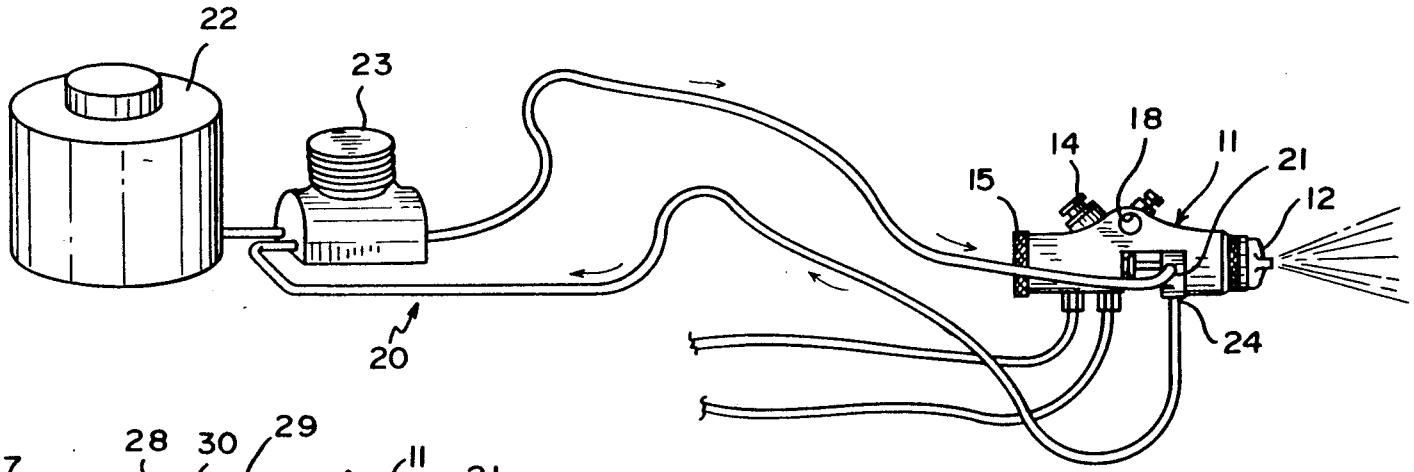
FIG. 2 (PRIOR ART)
FIG. 2 is a schematic perspective view of a prior art system in which paint is supplied to the spray gun from a remotely located paint holding tank and pump.
Figure 3:
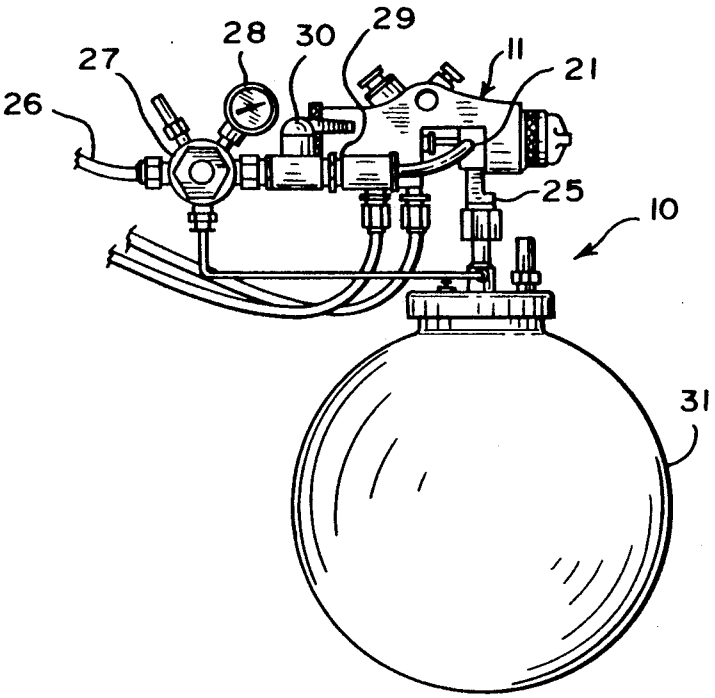
FIG. 3 is a fragmentary view in side elevation of the self-contained spray gun of the invention, showing a portion of the air supply lines that are connected to it.
Figure 4:
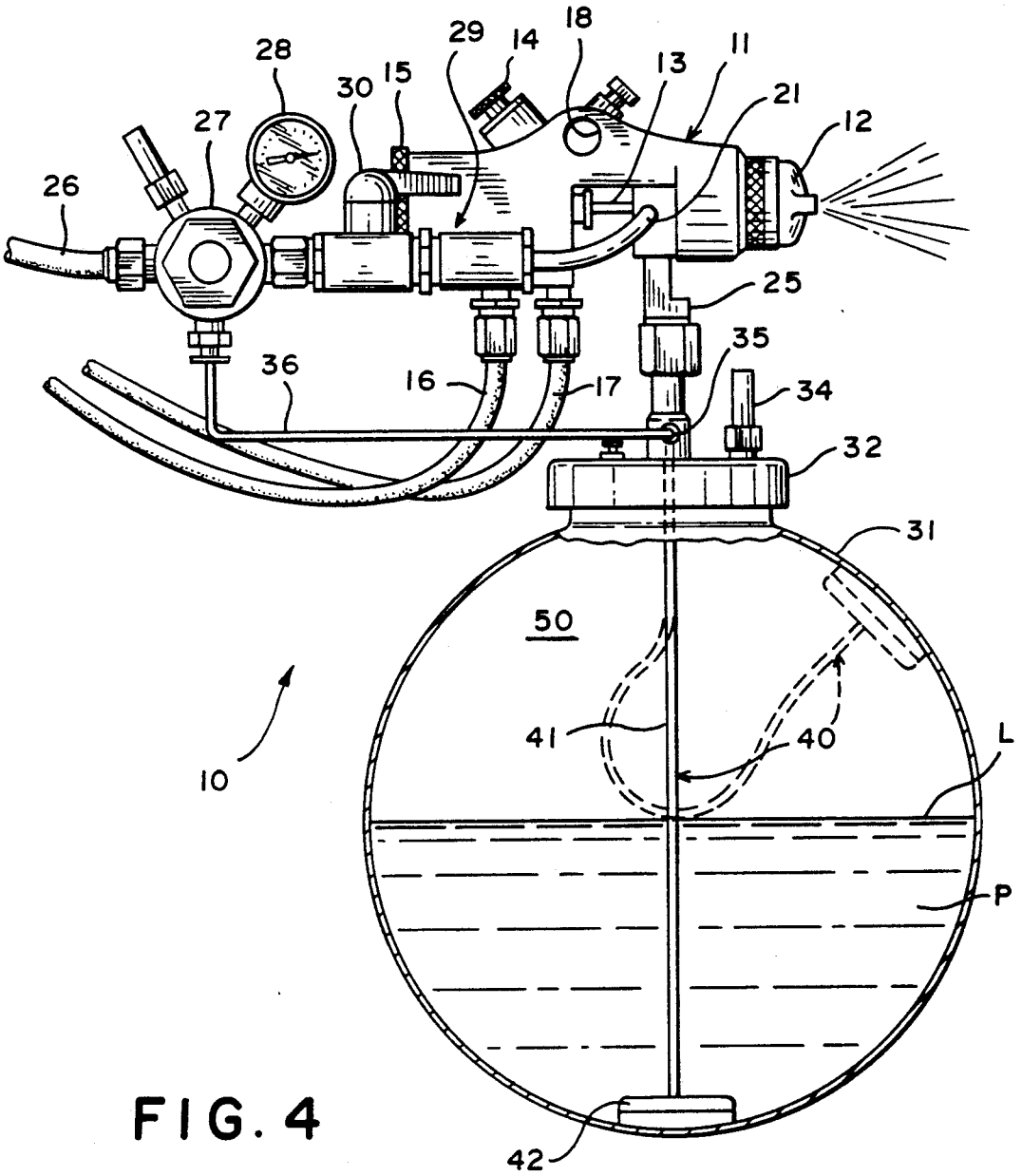
FIG. 4 is a side view in elevation of the paint spray gun of the invention, in a configuration for robotic spray painting systems.
Figure 5:
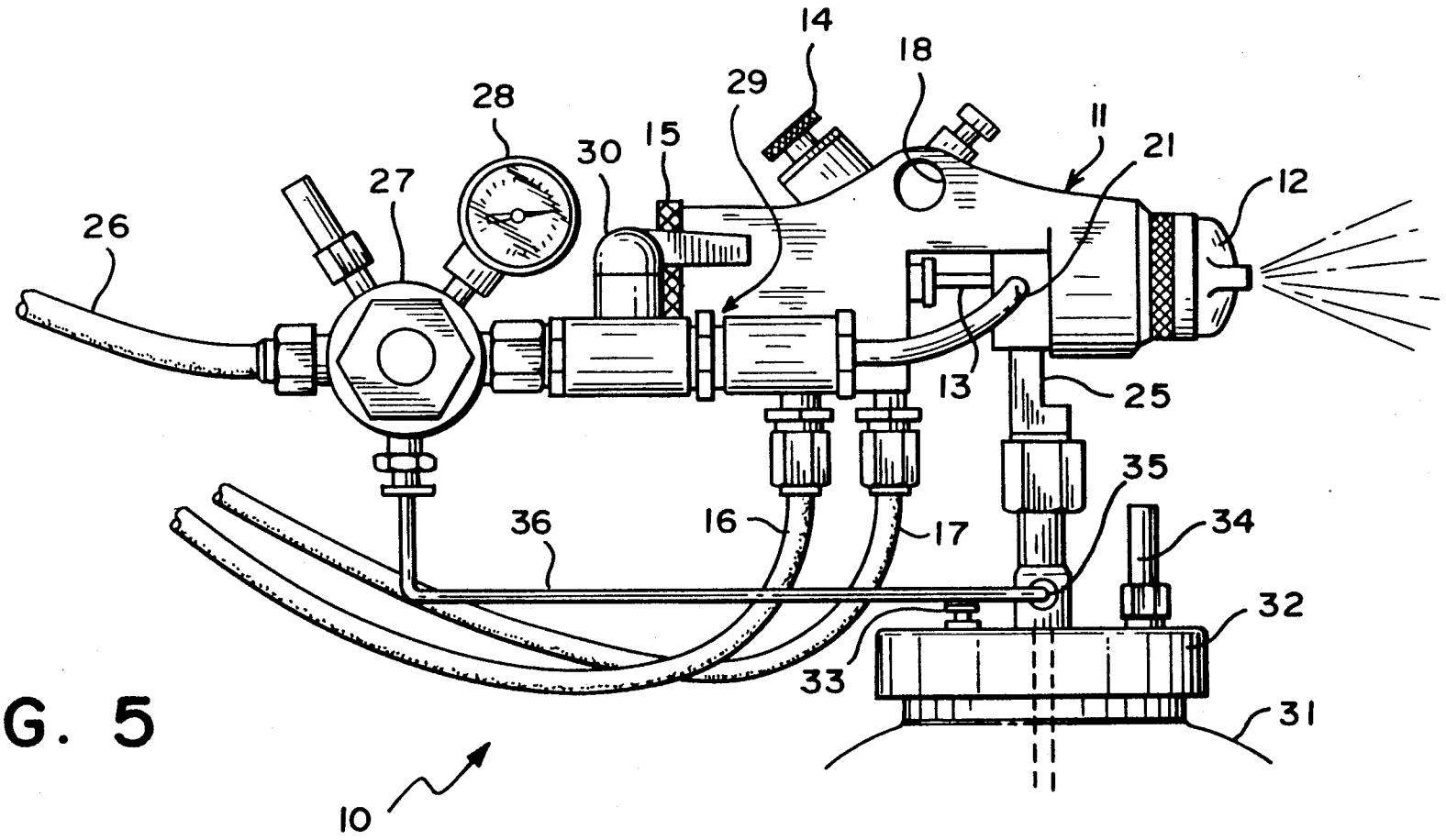
FIG. 5 is an enlarged view in side elevation of the spray gun of FIG. 4, showing only a portion of the spherical paint cup.

The gun shown is adapted from a gun normally used in a closed paint loop system, shown in FIG. 2 at 20. In the prior art closed loop, paint circulating system, the paint is circulated to a paint inlet fitting 21 on the gun from a remotely located paint holding tank 22 and pressure pump 23, and returned to the tank and pump via fitting 24.

In the invention, however, as seen best in FIGS. 4–8, the paint return line is eliminated, and a special fitting or union 25 is provided in its place. Additionally, the paint supply line is disconnected and an air supply line 26 is connected through a safety valve 27 and pressure regulator 28 to a purge system 29 that is connected with the fitting 21. Flow of air through the purge system is normally prevented by a valve 30, which, in one example, comprises a two-position (on-off) ball valve that is in closed position during a painting operation.

A spherical paint cup or container 31 is attached to the fitting 25 through a conventionally threaded coupling 32 as used to attach conventional paint cups to spray guns. The coupling 32 includes a conventional vent 33 and safety valve 34, and in addition is provided with an air inlet 35 for attachment of an air pressure line 36 leading from the regulator 28. Thus, air at the regulated pressure is supplied to the interior of the spherical paint container 31.

A flexible pick-up 40 is connected with the coupling 32 and fitting 25 for supplying paint from the container 31 to the head of the spray gun, and comprises a length of flexible tubing 41 with a weighted head 42 on its end for movement along the inner surface of the spherical container as the container is oriented to different positions. The spherical container and flexible pick-up insure that the weighted head will always remain at the lowest point in the container and will thereby remain immersed in paint as the spray gun and container are manipulated during a painting operation.

Figure 8:
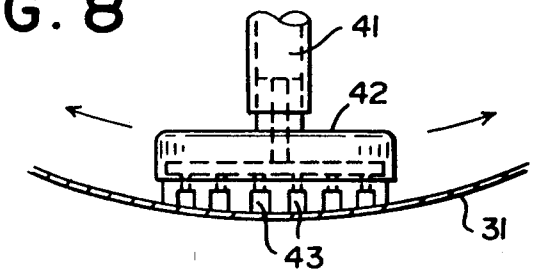
FIG. 8 is an enlarged end view of the paint pick-up of FIG. 7.
Figure 7:
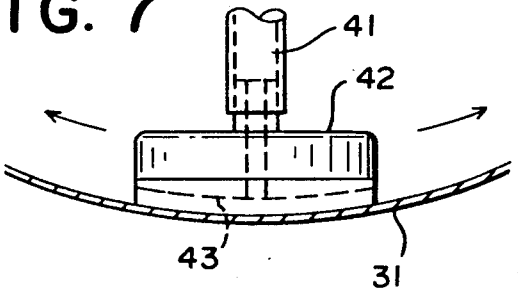
FIG. 7 is an enlarged side view of the weighted paint pick-up used in the gun of the invention.
Figure 6:
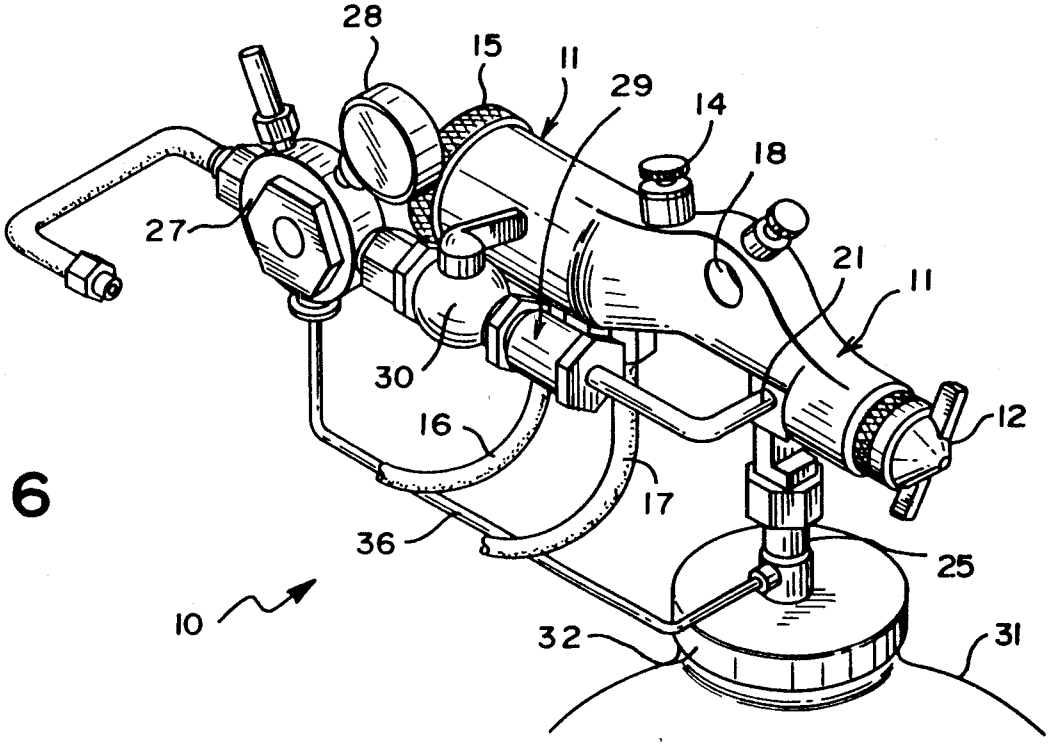
FIG. 6 is a top perspective view of the spray gun of FIG. 3.

As seen best in FIGS. 7 and 8, the weighted head 42 has a slotted or otherwise suitably apertured face 43 defining paint inlet openings which lie closely adjacent the inner surface of the container 31. This weighted head also functions as a paint mixing device during movements of the gun and container, insuring that the paint is continually mixed during operation of the apparatus.

In operation of the system of the invention, the spherical container 31 is filled with paint P to a level L, leaving a space 50 above the paint which functions as an accumulator chamber during operation. The valve 30 is closed and the mixing and spray pattern valves adjusted to desired positions. A robot arm R is attached to the robot attachment point, and a compressor (not shown)is actuated to supply air under pressure, usually 90 psi, to the regulator 28, which is typically set at 35 psi. This regulated air pressure is supplied through line 36 to the interior of container 31 for pressurizing the paint and forcing it through the flexible pick-up 40 and fitting 25 to the spray gun. Atomizing air under pressure is supplied to the gun through line 16, and, under control of the operator, air under pressure is supplied through line 17 to open the needle valve and enable paint to flow through the gun and nozzle.

The pressurized air in space 50 functions as a pressure accumulator and smooths out any fluctuations in air pressure to thereby insure smooth and constant flow of paint through the gun.

At the conclusion of a painting operation, or whenever it is desired to change the color, etc., of paint, or when it is otherwise desired to stop painting and clean out the system, it is necessary only to disconnect the paint container 31 and attach a container of cleaner (not shown) to the coupling 32 and open the valve 30, whereupon air under pressure will flow through the line 21 and through the head and nozzle of the gun to blow out any particles or paint residue. At the same time, air under pressure enters the container of cleaner and forces it through the flexible pick-up 40, and thence through the head and nozzle of the spray gun to clean paint from all areas of the system, making it ready for storage or the next container of paint to be used.

While the apparatus has been described in connection with a spray gun for spraying paint, it is to be understood that the invention is equally applicable to any system for spraying a material where clogging or waste of the material is a concern.

The foregoing is provided for illustrative purposes only and should not be construed as in any way limiting this invention, the scope of which is defined solely by the appended claims.

What is claimed is:

1. A self-contained paint spraying system, comprising:

a paint spray gun for spraying paint, said spray gun having a spray nozzle, paint inlet means, means for connecting the gun with a source of air under pressure, and control means for controlling flow of air and paint through the gun;

a spherically shaped paint cup attached directly to said paint inlet means for holding paint to be supplied to the gun, whereby said paint cup moves in unison with said gun; and a flexible paint pick-up connected to the paint inlet means and extending into the paint cup into proximity with an inner surface of the spherical wall thereof, said paint pick-up having means for maintaining it in contact with the inner surface of the cup and for automatically positioning it at the lowest point in the cup as the gun and attached cup are moved through different orientations, whereby the paint pick-up remains immersed in paint regardless of the position of the gun and cup.

2. A self-contained paint spraying system as claimed in claim 1, wherein:

said spray gun has a flow path for flow of air to and through said nozzle to atomize the paint; and a separate purge means is connected with said source of air under pressure and with said paint inlet means and said spray nozzle to cause flow of air under pressure through said inlet means and nozzle to clean paint residue and other foreign material from them when paint is not being sprayed.

3. A self-contained paint spraying system as claimed in claim 2, wherein:

said purge means includes a length of tubing external of said spray gun, extending from a source of air under pressure and connected directly to said inlet means; and normally closed valve means in said length of tubing to preclude flow of air through said purge means during a painting operation, said valve means being openable upon conclusion of a painting operation to enable flow of air under pressure through said purge means, inlet means and nozzle.

4. A self-contained paint spraying system as claimed in claim 3, wherein:

a safety valve and pressure regulator are in said purge means to regulate the pressure of air supplied to the inlet means when the valve means is opened.

5. A self-contained paint spraying system as claimed in claim 4, wherein:

a length of tubing is connected between said paint cup and said pressure regulator to supply regulated air pressure to said paint cup to pressurize the paint therein and force the paint through the inlet means and nozzle.

6. A self-contained paint spraying system as claimed in claim 5, wherein:

a space is left above the level of paint in the cup to form an accumulator chamber filled with air under pressure to smooth out fluctuations in air pressure and flow of paint from the cup to the gun.

7. A self-contained paint spraying system as claimed in claim 1, wherein:

a source of air under pressure is connected with said paint cup to pressurize the paint therein and force the paint through the inlet means and nozzle of the spray gun.

8. A self-contained paint spraying system as claimed in claim 7, wherein:

a pressure regulator is connected between the source of air under pressure and the paint cup to regulate the pressure of air supplied to the cup.

9. A self-contained paint spraying system as claimed in claim 1, wherein:

said paint pick-up includes a length of flexible tubing connected at one end with the paint inlet means and at its other end with a pick-up head that normally lies in close proximity with an inner surface of the paint cup, said pick-up head being weighted and adapted to slide along the inner surface of the cup as the orientation of the cup is changed, whereby the pick-up head remains at the lowest point of said cup and remains immersed in paint in the cup regardless of the orientation of the cup.

10. A self-contained paint spraying system as claimed in claim 9, wherein:

a source of air under pressure is connected with said paint cup to pressurize the paint therein and force the paint through the inlet means and nozzle of the spray gun.

11. A self-contained paint spraying system as claimed in claim 10, wherein:

a pressure regulator is connected between the source of air under pressure and the paint cup to regulate the pressure of air supplied to the cup.

12. A self-contained paint spraying system as claimed in claim 11, wherein:

a space is left above the level of paint in the cup to form an accumulator chamber filled with air under pressure to smooth out fluctuations in air pressure and flow of paint from the cup to the gun.

13. A self-contained paint spraying system as claimed in claim 12, wherein:

said spray gun has a flow path for flow of air to and through said nozzle to atomize the paint; and a separate purge means is connected with said source of air under pressure and with said paint inlet means and said spray nozzle to cause flow of air under pressure through said inlet means and nozzle to clean paint residue and other foreign material from them when paint is not being sprayed.

14. A self-contained paint spraying system as claimed in claim 13, wherein:

said purge means includes a length of tubing external of said spray gun, extending from a source of air under pressure and-connected directly to said inlet means; and normally closed valve means in said length of tubing of said purge means to preclude flow of air through said purge means during a painting operation, said valve means being openable upon conclusion of a painting operation to enable flow of air under pressure through said purge means, inlet means and nozzle.

15. A self-contained paint spraying system as claimed in claim 1, further comprising a robotic system including a robot arm defining an attachment point to which said paint spray gun is secured, said robotic system permitting said paint spray gun to be universally rotated.

* * * * *